US009314684B2

(12) United States Patent
Gribovsky et al.

(10) Patent No.: US 9,314,684 B2
(45) Date of Patent: Apr. 19, 2016

(54) PUTTING TRAINING AID

(71) Applicant: Vladimir Gribovsky, Mound, MN (US)

(72) Inventors: Vladimir Gribovsky, Mound, MN (US); Mitchell Crum, Murrells Inlet, SC (US)

(73) Assignee: Vladimir Gribovsky, Mound, MN (US)

( * ) Notice: Subject to any disclaimer, the term of this patent is extended or adjusted under 35 U.S.C. 154(b) by 141 days.

(21) Appl. No.: 14/247,998

(22) Filed: Apr. 8, 2014

(65) Prior Publication Data

US 2014/0302942 A1 Oct. 9, 2014

Related U.S. Application Data

(60) Provisional application No. 61/809,742, filed on Apr. 8, 2013.

(51) Int. Cl.
*A63B 69/36* (2006.01)
*A63B 71/06* (2006.01)

(52) U.S. Cl.
CPC ..... *A63B 69/3676* (2013.01); *A63B 57/10* (2015.10); *A63B 69/3641* (2013.01); *A63B 2069/3629* (2013.01); *A63B 2071/0694* (2013.01); *A63B 2220/18* (2013.01); *A63B 2225/12* (2013.01)

(58) Field of Classification Search
CPC ..... A63B 69/36; A63B 69/3676; A63B 2243/0029; A63B 2225/12; A63B 69/3641; A63B 206/3629; A63B 2071/0694; A63B 2220/189
USPC ..... 473/278, 257, 266–268
See application file for complete search history.

(56) References Cited

U.S. PATENT DOCUMENTS 3,934,874 A * 1/1976 Henderson ..... A63B 24/0003 473/265
4,344,624 A * 8/1982 Laursen ..... A63B 69/3676 473/159
4,368,888 A * 1/1983 Ren ..... A63B 57/0056 473/164
4,805,912 A * 2/1989 Hickman ..... A63B 67/02 473/159
5,131,659 A * 7/1992 Lindberg, Jr. ..... A63B 24/0003 359/838
5,294,124 A * 3/1994 Florian ..... A63B 24/0003 359/838
5,409,231 A * 4/1995 Kueng ..... A63B 69/3676 473/157
5,431,403 A * 7/1995 Pelz ..... A63B 67/02 473/160
5,707,301 A * 1/1998 Tollin ..... A63B 69/3667 473/252
6,520,866 B1 * 2/2003 Suzuki ..... A63B 24/0003 473/267
6,699,141 B1 * 3/2004 Florian ..... A63B 69/3641 473/257
6,869,288 B1 * 3/2005 Faulkner ..... A63B 69/3667 434/252
7,112,144 B2 * 9/2006 Mindlin ..... A63B 24/0003 473/218
8,376,871 B1 2/2013 Cloud
8,529,364 B1 * 9/2013 De Anda ..... A63B 69/3676 473/220
9,028,336 B2 * 5/2015 Vancho ..... A63B 67/02 473/157
2003/0148815 A1 8/2003 Swistock
2004/0152535 A1 8/2004 Thompson
2006/0063604 A1 * 3/2006 Amerson ..... A63B 69/3641 473/278
2013/0059673 A1 3/2013 Gribovsky
2014/0302942 A1 * 10/2014 Gribovsky ..... A63B 69/3676 473/257

FOREIGN PATENT DOCUMENTS

WO 2011146201 A1 11/2011

*Primary Examiner* — Raleigh W Chiu
(74) *Attorney, Agent, or Firm* — Moss & Barnett; Michael A. Bondi

(57) ABSTRACT

A putting training aid including an elongated body, a reflective mechanism and a tee. The elongated body has an upper surface. The reflective mechanism has an upper surface that is substantially aligned with the upper surface of the elongated body. The reflective mechanism has a length that is greater than a diameter of a golf ball that is used in conjunction with the putting training aid. The tee is formed in at least one of the elongated body and the reflective mechanism. The tee is adapted to receive a portion of the golf ball.

14 Claims, 2 Drawing Sheets

PUTTING TRAINING AID

REFERENCE TO RELATED APPLICATION

This application claims priority to U.S. Applic. No. 61/809,742, which was filed on Apr. 8, 2013. The contents of which are incorporated herein by reference.

FIELD OF THE INVENTION

The invention relates generally to devices used to improve the proficiency of golfing. More particularly, the invention relates to putting training aids.

BACKGROUND OF THE INVENTION

A variety of devices have been developed to enhance the proficiency of golfing in general and putting in particular. Depending upon the specific device, each may focus on one or more variables that enter into the putting stroke.

These variables can relate to body placement, such as the feet, shoulders, hips, hands and eyes in relation to the addressing of the ball. Further variables can relate to the striking force and the alignment and related eye-hand coordination pertaining to the backswing and follow through of the putting stroke.

The related complexity of the assembly varies depending upon the numbers of variables that the device attempts to correct through repetitive practice. Some of such devices provide prepared putting surfaces approximating the granularity of grass, which include practice holes. Some include electronic sensors to provide feedback about the stroke condition.

Some mimic the golf hole and provide a target hole that can be placed on a floor surface or in HVAC system registers to permit indoor practice. Some provide reflective mechanisms or magnetic indicators to assure certain head alignments. Others provide mechanical restraints to maintain arm, wrist and/or hand position to the putter.

Many assemblies also exist to assure a squared alignment of the putter head to the ball during and through the putting stroke motion. Some provide mechanical gauges and reflective mechanisms whereby the golfer is able to monitor head motion over the stroke. Some provide a guide surface, which the putter shaft follows to assure an aligned, squared travel motion.

Although a repetitive motion can be practiced with many of the latter devices, a deficiency exists in that the golfer does not have the benefit of the feedback of the ball travel to confirm the proper stroke motion.

Consequently, repetitive practice can merely result in a learned stroke, but which does not provide accurate results. Preferably, a training device should permit a normal stroke motion, while allowing the golfer to monitor selected portions of the motion and obtain a feedback of the resultant effect on ball travel.

One aspect of putting that has been recognized as being important to making puts is striking the golf ball with a proper putter orientation and swing such that the golf ball travels in a substantially straight line.

One such device is disclosed in Kueng et al., U.S. Pat. No. 5,409,231, which discloses an elongated golf stroke training device. The golf ball is positioned on the golf stroke training device and then struck with a putter where the goal is for the golf ball to roll along the golf stroke training device to an end of the device that is opposite the initial position of the golf ball.

In appreciation of the foregoing shortcomings, the present invention was developed to provide an assembly that allows a golfer to monitor initial positioning as well as stroke motion during the backswing motion, to assure the putter head is square to the ball, and to confirm a straight line ball travel in relation to an elongated travel path. A controlled, consistent backswing and follow through with corresponding putting accuracy are thereby obtained.

SUMMARY OF THE INVENTION

An embodiment of the invention is directed to a putting training aid having an elongated body, a reflective mechanism and a tee. The elongated body has an upper surface. The reflective mechanism has an upper surface that is substantially aligned with the upper surface of the elongated body.

The reflective mechanism has a length that is greater than a diameter of a golf ball that is used in conjunction with the putting training aid. The tee is formed in at least one of the elongated body and the reflective mechanism. The tee is adapted to receive a portion of the golf ball.

Another embodiment of the invention is directed to a putting training system that includes a golf ball, a putting training aid and a golf club. The golf ball has a diameter. The putting training aid includes an elongated body, a reflective mechanism and a tee.

The elongated body has an upper surface. The elongated body has a width that is less than a diameter of the golf ball. The reflective mechanism has an upper surface that is substantially aligned with the upper surface of the elongated body. The reflective mechanism has a length that is greater than a diameter of a golf ball that is used in conjunction with the putting training aid.

The tee is formed in at least one of the elongated body and the reflective mechanism. The tee is adapted to receive a portion of the golf ball. The golf club is capable of contacting the golf ball when placed on the tee to cause the golf ball to roll along the upper surface of the elongated body.

Another embodiment of the invention is directed to a method of practicing putting a golf ball. A putting training aid is provided that includes an elongated body, a reflective mechanism and a tee. The elongated body has an upper surface. The reflective mechanism has an upper surface that is substantially aligned with the upper surface of the elongated body. The tee is formed in at least one of the elongated body and the reflective mechanism.

A golf ball is positioned so that the tee receives a portion of the golf ball. The golf ball has a diameter that is greater than a width of the elongated body. The reflective mechanism has a length that is greater than a diameter of a golf ball that is used in conjunction with the putting training aid.

Prior to striking the golf ball with a golf club, a person adjusts a position of his or her body with respect to the putting training aid so that the person can see his or her eyes in the reflective mechanism. The golf club is moved with respect to the putting training aid to strike the golf ball to cause the golf ball to roll along the upper surface of the putting training aid.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE PREFERRED EMBODIMENTS

Figure 1:
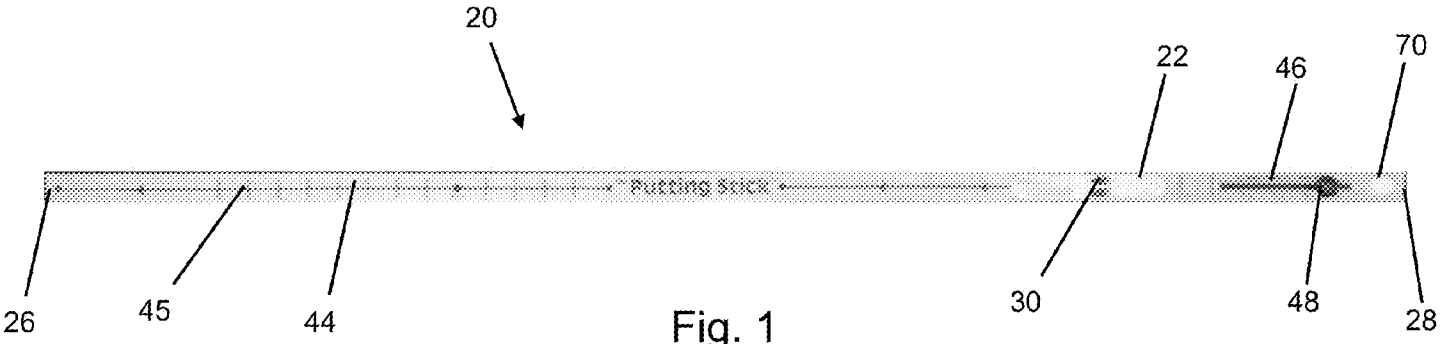
FIG. 1 is a top view of a putting training aid according to an embodiment of the invention.

An embodiment of the invention is directed to a putting training aid 20 that enhances the ability of a golfer to accurately position with respect to a golf ball 16 when putting using a golf club such as a putter 18. The putting training aid 20 generally includes an elongated body 21 and a reflective mechanism 22, as illustrated in the figures.

The putting training aid 20 thereby enables a person using the putting training aid 20 to monitor his or her alignment with respect to the golf ball 16 prior to putting as well as motion of a putter 18 and a path of a golf ball 16 after being struck by the putter 18. By using a consistent alignment with respect to the golf ball 16, the person using the putting training aid 20 is able to enhance the consistency of the golf swing. By monitoring the motion of the putter 18 such as a distance that the putter 18 moves on the backswing, the person is able to evaluate accuracy in which the golf ball 16 is struck. By monitoring the path of the golf ball 16 after being struck, the person is able to evaluate the accuracy in which the golf ball 16 is struck.

The elongated body 21 may be defined as having a first end 26 and a second end 28 at opposite ends thereof. The first end 26 is in the direction in which the golf ball 16 rolls after being struck by the putter 18. The second end 28 is opposite the first end 26.

The elongated body 21 is formed with a width that is sufficiently narrow to encourage the golfer to accurately putt the golf ball 16. In certain embodiments, the width of the elongated body 21 may be less than a width of the golf ball 16 that is to be used with the putting training aid 20. In other embodiments, the elongated body 21 has a width of about 1 inch.

The elongated body 21 is formed with a thickness that is sufficiently large such that the putting training aid 20 resists bending and breakage during use. As such, the thickness may be selected based upon the material from which the elongated body 21 is fabricated. In certain embodiments when the elongated body 21 is fabricated from a plastic material, the elongated body 21 has a thickness of about ⅜ of an inch.

The elongated body 21 is formed with a length that is sufficiently long to enable the golfer using the putting training aid 20 to ascertain that the golf ball has been putted in a substantially straight direction. In certain embodiments, the length of the elongated body 21 is at least ten times greater than the width of the elongated body 21. The length of the elongated body 21 is at least 24 inches. In other embodiments, the length of the elongated body 21 is about 48 inches.

The elongated body 21 may be fabricated from a variety of materials using the concepts of the invention. Examples of suitable materials include plastic, wood, metal or combinations thereof. In certain embodiments, at least a portion of the elongated body 21 is fabricated from a substantially clear plastic material.

Fabricating the elongated body 21 from the substantially clear plastic material enables indicia to be printed on a lower surface thereof. Alternatively, the indicia may be provided at an intermediate position that is between the upper and lower surfaces of the elongated body 21. Using either of the preceding configurations enables the upper surface of the elongated body 21 to be substantially smooth to facilitate the golf ball 16 rolling over the surface thereof. Alternatively, the indicia may be printed on the upper surface of the elongated body 21 in a manner that provides the upper surface of the elongated body 21 that is substantially smooth.

Proximate one end of the putting training aid 20, a tee 30 is provided. The tee 30 enables the golf ball to be retained in a substantially stationary position with respect to the putting training aid 20 before the golf ball is struck with the putter.

In certain embodiments, the tee 30 is a recess in the upper surface of the reflective mechanism 22. The tee 30 may have a generally circular shape. It is to be appreciated recesses of other shapes or alternatively raised surface protrusions can be formed into or on top of the upper surface of the putting training aid 20 to provide retention of the golf ball 16 in a substantially stationary position with respect to the putting training aid 20 before the golf ball 16 is struck by the putter 18.

The tee 30 should have a size that is sufficiently large to minimize the potential of the golf ball unintentionally moving out of the tee 30. On the other hand, the tee 30 should not be too large so that the golf ball smoothly rolls from the tee 30 and then continues to roll along the upper surface of the putting training aid 20.

While it is illustrated that the tee 30 is formed in the reflective mechanism 22, it is also possible for the tee 30 to be formed in the elongated body 21. While it is illustrated that the reflective mechanism 22 is a single piece that extends on opposite sides of the tee 30, it is possible for the reflective mechanism 22 to be formed in at least two sections that are positioned on opposite sides of the tee 30.

A ramp surface 32 may be provided on at least one side of the tee 30. The ramp surface 32 may intersect the upper and side surfaces of the putting training aid 20. The ramp surface 32 may have an arcuate shape. In certain embodiments, the ramp surface 32 is proximate to the tee 30 but does not intersect the tee 30. Alternatively, the ramp surface 32 intersects the tee 30 but proximate intersection of the tee 30 and the ramp surface 32, the tee 30 has a greater depth that the ramp surface 32 to minimize the potential of the golf ball 16 inadvertently rolling out of the tee 30.

The ramp surface 32 may thereby facilitate the golfer rolling the golf ball onto the tee 30 using the putter 18. The ramp surface 32 thereby enables the golfer to avoid bending down each time is it desired to place the golf ball 16 on the tee 30.

Figure 2:
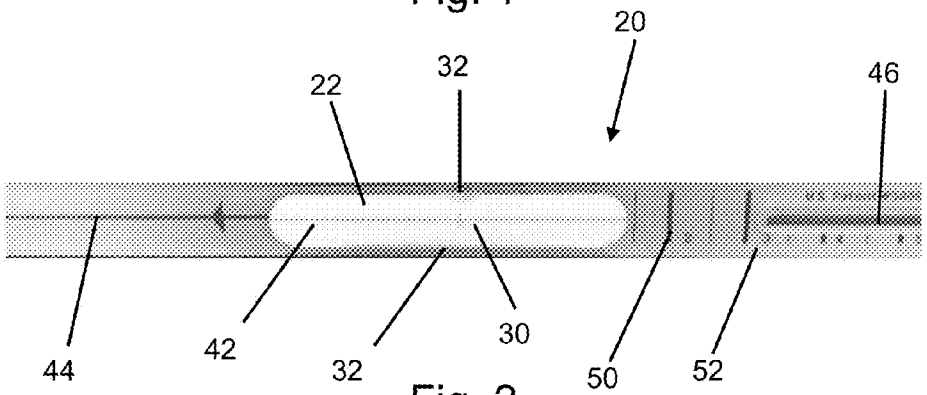
FIG. 2 is an enlarged top view of a reflective mechanism of the putting training aid of FIG. 1.

The reflective mechanism 22, which extends at least partially around the tee 30, may be fabricated from a reflective material, as illustrated in FIGS. 1 and 2. In certain embodiments, the tee 30 is located substantially intermediate opposite ends of the reflective mechanism 22. In certain embodiments, the reflective mechanism 22 may be fabricated from a different material than the other portions of the putting training aid 20.

The reflective mechanism 22 may be positioned proximate the second end 28 of the elongated body 21. In certain embodiments, there may be a spacing between the reflective mechanism 22 and the second end 28 of the elongated body 21. This spacing between the reflective mechanism 22 and the second end 28 may be used for additional components such as is described herein.

An upper surface of the reflective mechanism 22 may be substantially aligned with an upper surface of the elongated body 21 that is adjacent to the reflective mechanism 22. This configuration enables the golf ball to smoothly roll from the reflective mechanism 22 to the elongated body 21. This configuration may also reduce the potential of the reflective mechanism 22 being damaged.

In certain embodiments, the reflective mechanism 22 may have a width that is less than the width of the elongated body 21. This configuration is particularly desirable where the reflective mechanism 22 is fabricated from a material that is different than the material that is used to fabricate the elongated body 21. Such a configuration may increase the strength of the putting training aid 20 and thereby enhance the ability of the putting training aid 20 to resist bending or breakage.

The reflective mechanism 22 may be formed with a length that is greater than the diameter of the golf ball so that the person using the putting training aid 20 can see opposite ends of the reflective mechanism 22 when the golf ball is placed on the tee 30. In certain embodiments, the reflective mechanism 22 may have a length that is between about 4 inches and about 6 inches.

As an alternative to forming the reflective mechanism 22 separate from the other portions of the putting training aid 20, it is possible to form the reflective mechanism 22 by applying a reflective coating to the elongated body 21.

While it is also possible to form the putting training aid 20 substantially all from a reflective material, such a configuration may not be desirable because such other reflective portions may reduce the ability to see the indicia printed on the putting training aid 20.

The tee 30 may be positioned an approximately intermediate opposite ends of the reflective mechanism 22 to thereby facilitate the golfer viewing the ends of the reflective mechanism 22 on opposite sides of the golf ball 16.

At a location that is approximately equal distances from the side edges of the putting training aid 20, a first alignment line 42 is visible on an upper surface of the reflective mechanism 22. The first alignment line 42 should be sufficiently wide for the person using the putting training aid 20 to see the first alignment line 42 while minimizing the ability of the golfer to see reflection from the reflective mechanism 22.

A second alignment line 44 may be provided on the upper surface of the putting training aid 20 adjacent to the reflective mechanism 22. The second alignment line 44 may be generally aligned with the first alignment line 42. The second alignment line 44 may have a width that is approximately the same as the width of the first alignment line 42.

The putting training aid 20 may also include a plurality of indicia 45 that are provided in a spaced apart configuration. The plurality of indicia 45 may be referenced by the person using the putting training aid 20 to evaluate performance. For example, the person can determine that the swing proficiency is increasing when the golf ball 16 stays on the putting training aid 20 for a greater number of indicia from the tee 30. The indicia 45 may be accompanied by numbers such as may indicate distance in inches.

A slot 46 may be formed in the putting training aid 20 between the tee 30 and the second end 28 of the putting training aid 20. The slot 46 extends approximately five inches and permits selective positioning of a bumper 48 along the slot 46 in relation to the indicia.

The desired position of the bumper 48 may be fixed by rotating a threaded member (not shown) which extends from the bumper 48. If the putter 18 contacts the bumper 48, the golfer is notified that the backswing is too long.

The putting training aid 20 may include a plurality of lines 50 proximate the slot 46. At least some of these lines 50 may be accompanied by numbers 52 such as indicating distance in inches. The lines 50 and the numbers 52 assist the golfer in accurately positioning the bumper 48.

Figure 3:
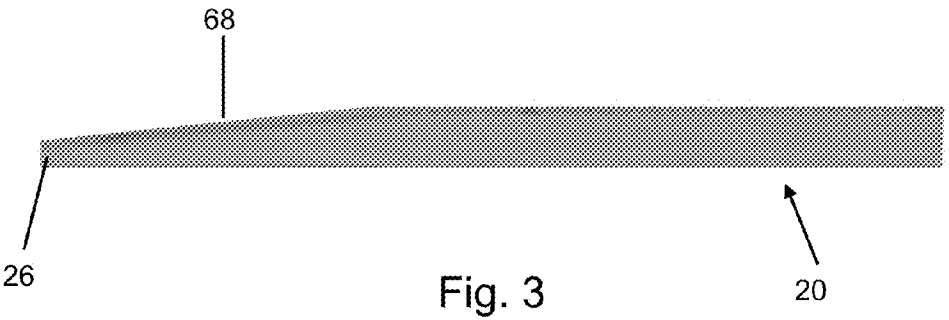
FIG. 3 is a side view of an end of the putting training aid of FIG. 1.
Figure 4:
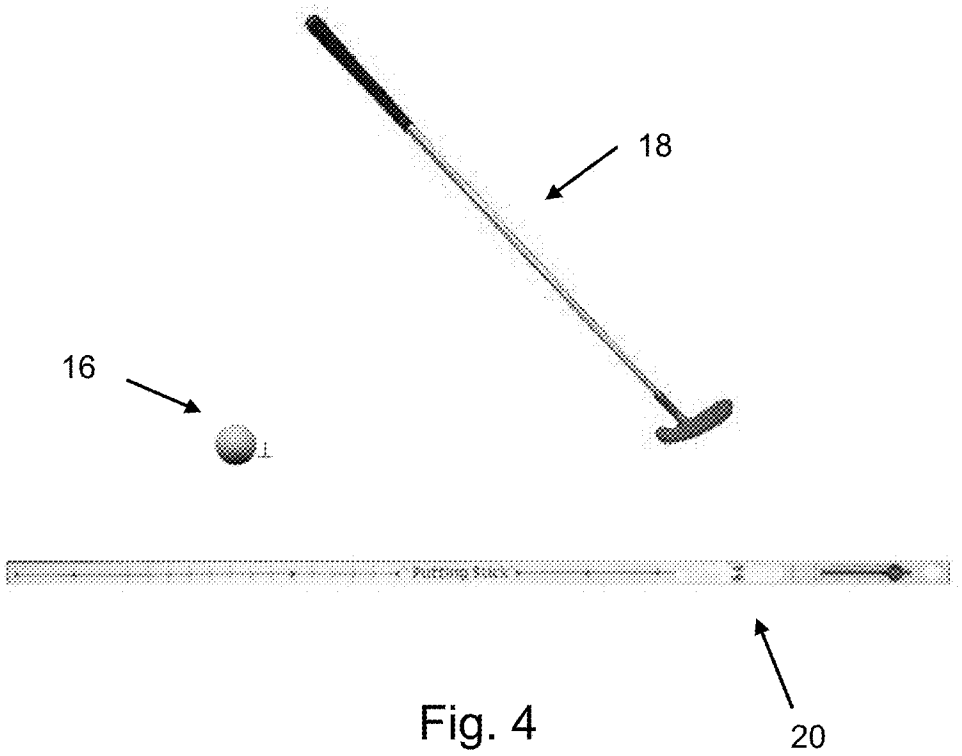
FIG. 4 is a side view of a putting training system according to an embodiment of the invention.

A tapered region 68 may be provided at the first end 26 of the putting training aid 20, as illustrated in FIG. 3. The tapered region 68 enhances the ability of the golf ball 16 to roll off the first end 26 of the putting training aid 20.

The tapered region 68 should not be too long because the tapered region 68 could reduce the strength of the putting training aid 20. In certain embodiments, the tapered region 68 has a length of between about 4 inches and about 8 inches.

A distal end of the tapered region 68 should be sufficiently thick so that the putting training aid 20 resists damage or breakage. In certain embodiments, the distal end of the tapered region 68 has a thickness that is about ½ of the thickness of the other portions of the putting training aid 20.

Such a configuration is particularly suited for when the putting training aid 20 is being used on a golf green so that the golf ball 16 will smoothly roll off the end of the putting training aid 20 and proceed to the hole on the golf green.

The putting training aid 20 may include a leveling device 70. In certain embodiments, the leveling device 70 is proximate the second end 28 of the putting training aid 20, which is opposite the path in which the golf ball 16 rolls along the putting training aid 20. The leveling device 70 may include a bubble, which enables the level of the putting training aid 20 to be evaluated in more than one direction.

If the leveling device 70 is provided in a portion of the first end 26 of the putting training aid 20, the leveling device 70 may be recessed in the putting training aid 20 so that the upper surface of the putting training aid 20 is substantially flat.

In operation, the putting training aid 20 is placed on a ground surface. It is possible for the leveling device 70 to be used to ensure that the putting training aid 20 is substantially level.

Alternatively, when the putting training aid 20 is used on an unlevel surface such as a golf green, the person using the putting training aid 20 can use the leveling device 70 to evaluate the orientation of the golf green.

Next, the golf ball 16 is placed in the tee 30 and the person grasps the putter 18. The person then attempts to position himself or herself in a desired position with respect to the golf ball 16. Thereafter, the person looks at the reflective mechanism 22 to see if the person can see his or her eyes. When this happens, the person knows that he or she is correctly aligned.

The person swings the putter 18 and strikes the golf ball 16 such that the golf ball 16 is propelled along the putting training aid 20. The distance in which the golf ball 16 remains on the putting training aid 20 enables the person using the putting training aid to evaluate whether the swing is accurate.

The invention provides a golfer with instant feedback in a variety of areas that are important to success. The golfer can determine whether his or her eyes are directly over the golf ball at the start of the golf stroke. If the back swing is too long, the putter 18 will contact the bumper 48.

The golfer can determine the orientation of the putter face when the putter 18 contacts the golf ball 16. The putter face should be oriented straight with respect to the golf ball 16. If the putter face is in an open orientation, the golf ball 16 will roll off the putting training aid 20 to the right. If the putter face is in a closed orientation, the golf ball 16 will roll off the putting training aid 20 to the left. The preceding comments are with respect to a right handed golfer. The movement of the golf ball 16 would be opposite what is described above for a left handed golfer.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A putting training aid comprising:

an elongated body having an upper surface, wherein the elongated body has a width that is less than a diameter of a golf ball that is used in conjunction with the putting training aid;

a reflective mechanism having an upper surface that is substantially aligned with the upper surface of the elongated body, wherein the reflective mechanism has a length that is greater than a diameter of a golf ball that is used in conjunction with the putting training aid and wherein the reflective mechanism has a first end and a second end; and a tee formed in the reflective mechanism between the first end and the second end thereof, wherein the tee is adapted to receive a portion of the golf ball.

2. The putting training aid of claim 1, wherein the reflective mechanism is mounted in a recess formed in the elongated body.

3. The putting training aid of claim 1, wherein the elongated body has a length that is at least ten times greater than a width.

4. The putting training aid of claim 1, wherein the elongated body has a first end and a second end at opposite ends thereof, wherein the elongated body has a first edge and a second edge that both extend between the first end and the second end, wherein a first alignment line is provided on the elongated member, wherein the first alignment line is oriented to at least partially extend between the first end and the second end and wherein the first alignment line is intermediate the first edge and the second edge.

5. The putting training aid of claim 4, and further comprising a second alignment line on the reflective mechanism, wherein the second alignment line is substantially aligned with the first alignment line.

6. The putting training aid of claim 1, and further comprising a ramp surface formed in at least one of the elongated body and the reflective mechanism proximate the recess.

7. The putting training aid of claim 1, wherein the elongated body further comprises a tapered thickness region proximate a first end thereof.

8. The putting training aid of claim 1, and further comprising a leveling device that displays levelness of the putting training aid in at least one direction.

9. A putting training system comprising:

a golf ball having a diameter;

a putting training aid comprising:

an elongated body having an upper surface, wherein the elongated body has a width that is less than a diameter of the golf ball;

a reflective mechanism having an upper surface that is substantially aligned with the upper surface of the elongated body, wherein the reflective mechanism has a length that is greater than a diameter of a golf ball that is used in conjunction with the putting training aid and wherein the reflective mechanism has a first end and a second end; and a tee formed in the reflective mechanism between the first end and the second end thereof, wherein the tee is adapted to receive a portion of the golf ball; and a golf club that is capable of contacting the golf ball when placed on the tee to cause the golf ball to roll along the upper surface of the elongated body.

10. The putting training system of claim 9, wherein the reflective mechanism is mounted in a recess formed in the elongated body.

11. The putting training system of claim 9, wherein the elongated body has a first end and a second end at opposite ends thereof, wherein the elongated body has a first edge and a second edge that both extend between the first end and the second end and further comprising:

a first alignment line is provided on the elongated member, wherein the first alignment line is oriented to at least partially extend between the first end and the second end, wherein the first alignment line is intermediate the first edge and the second edge; and a second alignment line on the reflective mechanism, wherein the second alignment line is substantially aligned with the first alignment line.

12. The putting training system of claim 9, and further comprising a ramp surface formed in at least one of the elongated body and the reflective mechanism proximate the recess.

13. The putting training system of claim 9, wherein the elongated body further comprises a tapered thickness region proximate a first end thereof.

14. The putting training system of claim 9, and further comprising a leveling device that displays levelness of the putting training aid in at least one direction.

* * * * *